United States Patent [19]

de Wet

[11] Patent Number: 4,506,885

[45] Date of Patent: Mar. 26, 1985

[54] EXERCISING DEVICE AND METHOD

[76] Inventor: Ernest P. de Wet, 6 Alpha St., Cape Town, South Africa, 7700

[21] Appl. No.: 496,533

[22] Filed: May 20, 1983

[30] Foreign Application Priority Data

Jul. 2, 1982 [ZA] South Africa ..... 82/4751

[51] Int. Cl.[3] ..... A63B 21/22; A63B 23/02

[52] U.S. Cl. ..... 272/128

[58] Field of Search ..... 272/128, 93, 116, 117, 272/120–126, 106; 273/67 R, 67 C, 67 D, 83, 80 R, 80 D, 80.1, 170, 193 A, 194 B; 145/29 R

[56] References Cited

U.S. PATENT DOCUMENTS 1,253,700 1/1918 McLaughlin ..... 273/80 D
3,351,346 11/1967 Strahan ..... 272/124 X
3,712,652 1/1973 Uilkema ..... 273/80 D
3,771,788 11/1973 Hurley et al. ..... 273/83

FOREIGN PATENT DOCUMENTS 11038 of 1911 United Kingdom ..... 272/106

*Primary Examiner*—Robert A. Hafer
*Assistant Examiner*—Chris Coppens

[57] ABSTRACT

An exercising device 10 comprises a relatively light-weight shank 12 having a longitudinally extending handle 14 at one end thereof and a pair of relatively massy heads 16.1 and 16.2 at the other end. The heads are spaced from and disposed on opposite sides of the longitudinal axis 24 of the handle and the shank, and are connected to the shank and to one another by a relatively light-weight connecting structure 18. The moment of inertia of the head 16.1 about the axis 24 is about a third as great as that of the head 16.2.

4 Claims, 4 Drawing Figures

EXERCISING DEVICE AND METHOD

FIELD OF THE INVENTION

This invention relates to an exercising device and to a method of doing body exercises.

SUMMARY OF THE INVENTION

According to the invention there is provided an exercising device which comprises:

a relatively light-weight shank defining an elongate, longitudinally extending handgrip at one end thereof; and a pair of relatively massy heads at the other end of the shank, the heads being spaced from, and disposed on opposite sides of, an imaginary axis coinciding with the longitudinal direction of the hand grip, and being connected to one another and to the shank by a relatively light-weight connecting structure.

The moment of inertia about said axis of one of the heads may be substantially greater than that of the other head. Thus, for example, the moment of inertia about said axis of the one head may be about one third greater than that of the other head.

The distance between the hand grip and the head may be in the order of 0.7 m, the combined mass of the two heads in the order of 2 kg, and the combined moment of inertia about said axis of the two heads in the order of 0.03 kg-m squared.

The shank may be provided with means for enabling the distance between the hand grip and the heads to be adjusted.

The heads may be connected disconnectably to the shank.

Each head may comprise a core of relatively hard material, and a sleeve of relatively soft, resilient material covering at least part of the core.

Further according to the invention there is provided a method of doing body exercises which includes:

providing an exercising device having a shank defining an elongate longitudinally extending hard grip at one end thereof, and having a massy head at the other end of the shank;

holding the device by means of said handle in one's hands;

swinging the device so that the head moves in repeated cycles arround one's body; and manipulating the handle so as to cause rotation of the head about a longitudinally extending axis of rotation in one direction for part of each cycle and in the opposite direction for another part of each cycle.

BRIEF DESCRIPTION OF THE DRAWINGS

The invention will now be described in more detail, by way of example, with reference to the accompanying drawings.

In the drawings.

DETAILED DESCRIPTION OF THE DRAWINGS

Figure 1:
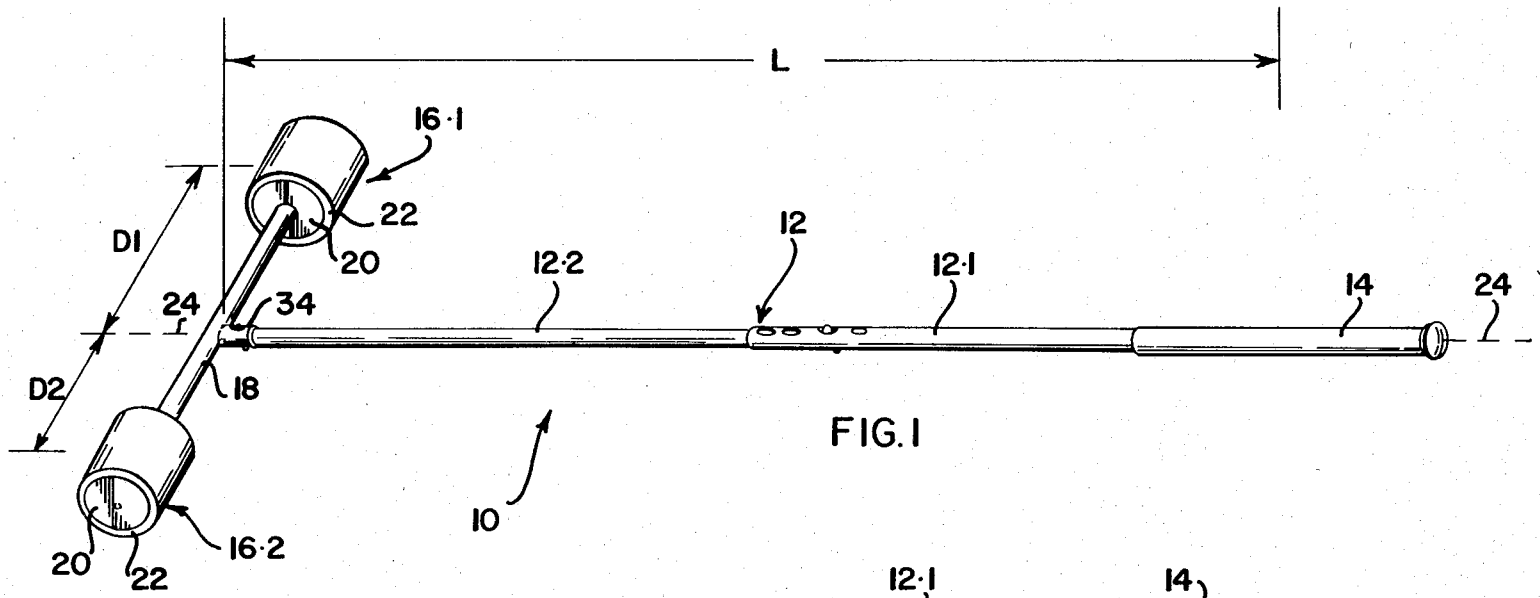
FIG. 1 is a three dimensional view of an exercising device in accordance with the invention, shown in its assembled condition.

Referring first to FIG. 1, reference numeral 10 generally indicates an exercising device which comprises a longitudinally extending shank 12 defining an elongate, longitudinally extending hand grip 14 at one end thereof, and a pair of heads 16.1 and 16.2 at the other end of the shank. The two heads 16.1, 16.2 are connected to one another and to the shank by a connecting structure in the form of a transversely extending tube 18. The shank 12 is also of tubular structure and is in two parts, namely a part 12.1 and a part 12.2, which are connected to one another disconnectably as will hereinafter be described in more detail, with reference to FIG. 3. In a similar manner, the transversely extending tube 18 is disconnectably connected to the corresponding end of the shank 12.

Each head 16.1, 16.2 comprises a solid, cylindrical mild steel core 20 and a rubber sleeve 22, surrounding the cylindrical sides of the core. The purpose of the sleeves 22 is to prevent damage to other objects which the heads may accidentally hit.

As will be seen in the drawings, the two heads 16.1, 16.2 are spaced from, and disposed on opposite sides of, an imaginary axis 24 which coincides with the longitudinal direction of the handle 14 and the shank 12. The distance D1 of the centre of gravity of the head 16.1 from the axis 24 is about 0.108 m, and the distance D2 of the centre of gravity of the head 16.2 from the axis 24 is about 0.138 m. The mass of each of the heads 16.1, 16.2 is about 1 kg. This gives the heads 16.1, 16.2 a combined moment of inertia of about 0.03 kg-m squared and the head 16.1 a moment of inertia of about one thirds greater than that of the head 16.2. The length L from the heads 16.1, 16.2 to a point midway between the ends of the hand grip 14 is about 0.7 m. This length can be varied, if desired, as will hereinafter be described with reference to FIG. 3.

The total mass of the exercising device is about 2.25 kg. Thus, the mass of the shank 12 and the transversely extending tube 18 is small in comparison with that of the heads 16.1, 16.2.

Figure 2:
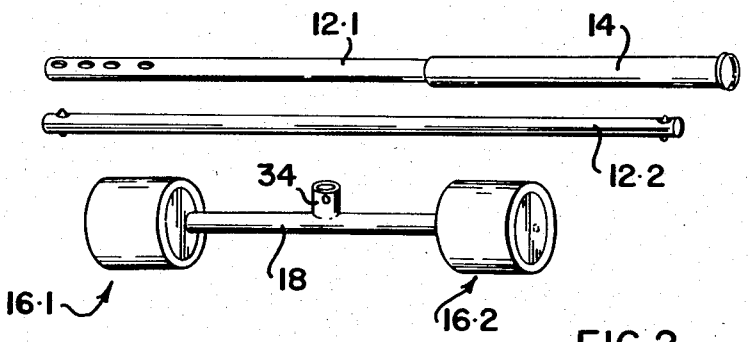
FIG. 2 shows the exercising device in a dismantled condition.

In FIG. 2 the exercising device is shown in its dismantled condition for ease of storage or transport.

Figure 3:
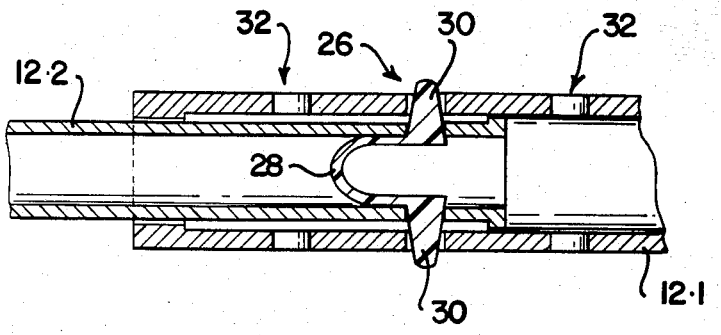
FIG. 3 is a longitudinal section of part of the shank of the exercising device, drawn to a larger scale.

Referring now to FIG. 3, it will be seen that the two parts 12.1 and 12.2 of the shank 12 are telescopically slidable with respect to one another and are held in position by detent means 26 comprising a spring member 28 inside the part 12.2 and two stubs 30 connected to the spring member 28. The stubs protrude through openings in the sides of the part 12.2 and each enters one of a number of longitudinally spaced openings 32 in the sides of the member 12.1. By depressing the stubs 30 and causing them to enter another pair of openings 32, the length L can be varied. The other end of the part 12.2 fits into a socket member 34 secured to the transversely extending tube 18 (see FIGS. 1 and 2). Connection between the part 12.2 and the socket member 34 is effected by means of detent means similar to that shown in FIG. 3, although in this case the position of the part 12.2 relative to the tube 18 is not variable.

Figure 4:
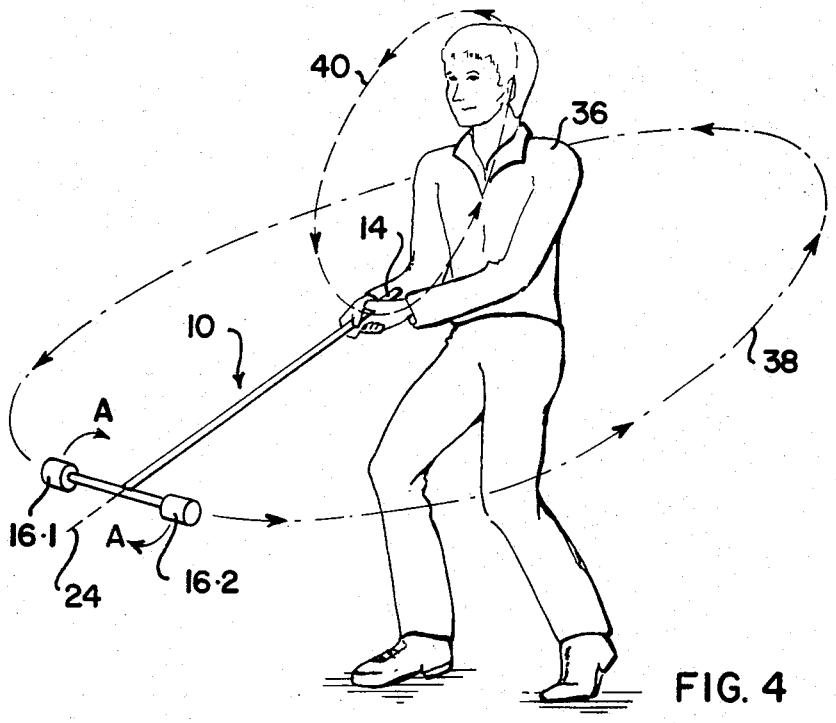
FIG. 4 shows the exercising device in use.

Referring now to FIG. 4, there is shown a man 36 doing exercises with the exercising device 10. As will be seen, he holds the device 10 by the hand grip 14 in the manner of a golf club. To start the exercises, he can swing the device round his body either in a clockwise direction or in an anti-clockwise direction, with the head 16.2, as the device passes in front of him, leading. In the drawing he is shown swinging the device in an anti-clockwise direction (as viewed from the top).

Each time the heads 16.1, 16.2 pass in front of him, the user imparts an anti-clockwise spin momentum to the heads, about the axis 24 (i.e. in the direction of arrows A in FIG. 4), by twisting the hand grip 14. The hand grip 14 is, however, held firmly so that the handle 14 cannot spin relative to his hands. The movements described above are repeated in a continuous rythmic fashion, the approximate path followed by the heads being indicated by chain-dotted line 38, and that followed by the user's hands being indicated by dotted line 40.

Applicant has found that, as the heads move rearwardly on the left hand side of the user, the heads 16.1, 16.2 propel themselves upwardly and the hand grip automatically also rises so that, apart from the twisting force, no effort has to be made by the user to lift his hands and the heads. As the heads move forwardly on the right hand side of the user, the heads lose their spin momentum and descend. The hand grip 14 also descends automatically, whereupon a twisting force is again required to maintain the propelling action.

I claim:

1. An exercising device which comprises:

a light-weight shank defining an elongate, longitudinally extending hand grip at one end thereof; and a pair of massy heads at the other end of the shank, the heads being spaced from, and disposed on opposite sides of, an imaginary axis coinciding with the longitudinal direction of the hand grip, and being connected to one another and to the shank by a light-weight connecting structure, whereby a person, in doing body exercises with the device, can hold the device by means of said hand grip, swing the device so that the heads move in repeated cycles around the person's body, and impart a spin momentum to the heads about said axis each time the heads pass in front of the person, the connecting structure being a thin rod-like portion with said massy heads of substantially larger diameter then said connecting structure, being disposed at opposite ends of the connecting structure, the combined mass of said heads being in the order of about 2 kg and being substantially greater than the mass of the shank and the connecting structure, and the moment of inertia of one of said heads about said axis being substantially greater than that of said other head.

2. An exercising device according to claim 1, wherein each head comprises a core of relatively hard material, and a sleeve of relatively soft, resilient material covering at least part of the core.

3. An exercising device according to claim 1, wherein the combined moment of inertia about said axis of the two heads is in the order of about 0.03 kg-m squared.

4. A method of doing body exercises which includes:

providing an exercising device having a shank defining an elongate longitudinally extending hand grip at one end thereof, and having a pair of massy heads at the other end of the shank the heads being spaced from, and disposed on opposite sides of, an imaginary axis coinciding with the longitudinal direction of the hand grip and being connected to one another and to the shank by a light-weight connecting structure;

holding the device by means of said hand grip in one's hands;

swinging the device so that the head moves in repeated cycles around one's body; and imparting a spin momentum to the heads about said axis each time the heads pass in front of one's body.

* * * * *